US006554005B1

(12) United States Patent
Cords et al.

(10) Patent No.: US 6,554,005 B1
(45) **Date of Patent: *Apr. 29, 2003**

(54) CLEANING METHOD FOR POLYETHYLENE TEREPHTHALATE CONTAINERS

(75) Inventors: Bruce R. Cords, Eagan, MN (US); Gerald K. Wichmann, Maple Grove, MN (US); Guang-Jong Jason Wei, Mendota Heights, MN (US); David D. McSherry, Minneapolis, MN (US); Brandon L. Herdt, Farmington, MN (US); Arturo Valencia, Edo de Mexico (MX)

(73) Assignee: Ecolab Inc., St. Paul, MN (US)

( * ) Notice: Subject to any disclaimer, the term of this patent is extended or adjusted under 35 U.S.C. 154(b) by 18 days.

This patent is subject to a terminal disclaimer.

(21) Appl. No.: 09/668,972

(22) Filed: Sep. 25, 2000

Related U.S. Application Data

(63) Continuation of application No. 09/297,993, filed as application No. PCT/US96/18261 on Nov. 15, 1996, now Pat. No. 6,247,478.

(51) Int. Cl.[7] ..... B08B 3/04; B08B 3/08; C11D 3/075; C11D 3/36

(52) U.S. Cl. ..... 134/22.1; 134/22.19; 134/25.1; 134/25.2; 134/25.4; 134/35; 510/219; 510/243; 510/405; 510/421; 510/434; 510/435; 510/436; 510/477; 510/480

(58) Field of Search ..... 510/243, 219, 510/405, 421, 434, 435, 436, 477, 480; 134/25.2, 25.1, 22.1, 25.4, 22.19, 35

(56) References Cited

U.S. PATENT DOCUMENTS

| | | | | |
|---|---|---|---|---|
| 3,350,346 | A | 10/1967 | Maxson | |
| 3,352,787 | A | 11/1967 | Bodach | |
| 3,574,100 | A | 4/1971 | Wetmore | |
| 3,583,914 | A | 6/1971 | Garvin et al. | |
| 3,706,676 | A | * 12/1972 | Franke et al. | 510/471 |
| 3,718,588 | A | 2/1973 | Bellos et al. | |
| 3,766,068 | A | 10/1973 | Tesdahl et al. | |
| 3,860,521 | A | 1/1975 | Aepli et al. | |
| 4,220,611 | A | 9/1980 | Wolf | |
| 4,289,636 | A | 9/1981 | Davis et al. | |
| RE30,885 | E | 3/1982 | Rieder | |
| 4,521,321 | A | 6/1985 | Anderson et al. | |
| 4,552,569 | A | 11/1985 | Horodysky | |
| 4,604,220 | A | 8/1986 | Stanton | |
| 4,670,169 | A | 6/1987 | Adams et al. | |
| 4,719,084 | A | 1/1988 | Schmid et al. | |
| 4,770,801 | A | 9/1988 | Adams et al. | |
| 4,828,735 | A | 5/1989 | Minagawa et al. | |
| 4,839,067 | A | 6/1989 | Jansen | |
| 4,895,668 | A | 1/1990 | Singh et al. | |
| 4,929,375 | A | 5/1990 | Rossio et al. | |
| 4,938,884 | A | 7/1990 | Adams et al. | |
| 5,001,114 | A | 3/1991 | McDaniel, Jr. | |
| 5,009,801 | A | 4/1991 | Wider et al. | |
| 5,062,978 | A | 11/1991 | Weber et al. | |

(List continued on next page.)

FOREIGN PATENT DOCUMENTS

| | | |
|---|---|---|
| AU | B-50919/90 | 6/1992 |
| EP | 0 044 458 A1 | 1/1982 |
| EP | 0 137 057 A1 | 4/1985 |
| EP | 0 233 774 A3 | 8/1987 |
| EP | 0 293 820 A2 | 12/1988 |
| EP | 0 302 705 A2 | 2/1989 |
| EP | 0 310 363 A1 | 4/1989 |
| EP | 0 372 628 A2 | 6/1990 |
| EP | 0 384 282 A1 | 8/1990 |
| EP | 0 533 552 A1 | 3/1993 |
| JP | 2-55794 | 2/1990 |
| WO | WO 90/10053 | 9/1990 |
| WO | WO 92/13048 | 8/1992 |
| WO | WO 92/13049 | 8/1992 |
| WO | WO 94/17170 | 8/1994 |
| WO | WO 95/14795 | 6/1995 |
| WO | WO 95/26389 | 10/1995 |
| WO | WO 96/02616 | 2/1996 |
| WO | WO 97/45509 | 12/1997 |

OTHER PUBLICATIONS

Laufenberg, A. et al., "Cleaning Disinfecting and Transporting Pet Returnables", *BBII,* pp. 40–44 (Jan. 1992).

Magne, F.C. et al., "Lubricants and Lubricant Additives: II. Performance Characteristics of Some Substituted Fatty Acid Esters", *Journal of the American Oil Chemists Society,* vol. 52, pp. 494–497 (Dec. 1975).

*Journal of the American Oil Chemists Society,* vol. 52, pp. 494–497 (Dec. 1975).

Baker, M., "Global study of refillable PET", *Canadian Packaging,* vol. 45, p. 12(3) (Mar. 1992) (Dialog Full Text Article).

"Code of Practice: Guidelines for an Industrial Code of Practice for Refilable PET Bottles", TNO Nutrition and Food Research, Edition 1, 3 pages (1993–1994).

"Filling returnable PET bottles", *Packaging,* vol. 64, p. 9(2) (Oct. 1993) (Dialog Full Text Article).

*Primary Examiner*—Lorna M. Douyon
(74) *Attorney, Agent, or Firm*—Merchant & Gould P.C.

(57) ABSTRACT

A method for cleaning polyethylene terephthalate containers including contacting the PET container with an alkaline wash solution having a temperature ranging of less than about 60° C. is disclosed. The alkaline wash solution is formulated from a first concentrate, a second concentrate, an alkalinity source, and a balance of water. The first concentrate preferably has a first nonionic surfactant, a first builder, and acid in an amount effective to provide a phase stable solution. The second concentrate preferably has a second nonionic surfactant and a second builder. The first and second concentrate are present in the wash solution in a concentration ranging from about 0.3 wt. % to 2.0 wt. %. Preferably, the first nonionic surfactant has a cloud point ranging from about 5° C. to 60° C.

51 Claims, No Drawings

U.S. PATENT DOCUMENTS 5,062,979 A 11/1991 Scharf et al.
5,073,280 A 12/1991 Rossio et al.
5,080,814 A 1/1992 Awad
5,174,914 A 12/1992 Gutzmann
5,182,035 A 1/1993 Schmidt et al.
5,223,162 A 6/1993 Rossio
5,352,376 A 10/1994 Gutzmann
5,389,283 A * 2/1995 Help, III ..... 134/40
5,391,308 A 2/1995 Despo
5,441,654 A 8/1995 Rossio
5,510,045 A 4/1996 Remus
5,559,087 A 9/1996 Halsrud et al.
5,723,418 A 3/1998 Person Hei et al.
5,863,874 A 1/1999 Person Hei et al.
5,925,601 A 7/1999 McSherry et al.
5,932,526 A 8/1999 Person Hei et al.
6,247,478 B1 * 6/2001 Cords et al. ..... 134/22.1

* cited by examiner

CLEANING METHOD FOR POLYETHYLENE TEREPHTHALATE CONTAINERS

This application is a continuation of application Ser. No. 09/297,993, filed Jul. 7, 1999, now U.S. Pat. No. 6,247,478, which is a 371 of PCT/US96/18261 filed Nov. 15, 1996, which application(s) are incorporated herein by reference.

FIELD OF THE INVENTION

The invention relates generally to methods and compositions for cleaning polyethylene terephthalate containers. More specifically, the invention relates to methods and compositions which remove mold, present on polyethylene terephthalate containers, with reduced hazing.

BACKGROUND OF THE INVENTION

As with many industries, the drive towards economy has also effected the beverage industry and has resulted in certain real changes in the way in which beverages are bottled, distributed and dispensed. In the last decade the beverage industry has seen a switch from glass to plastic containers. Plastic containers may be made from any number of materials depending on the application. One material is polyethylene terephthalate, "PET". Two types of PET bottles that are commonly used are single trip and multi-trip bottles. Single trip bottles are those which are filled, used, and then discarded. Multi-trip bottles are collected and reused and must be washed before refilling.

PET bottles offer several advantages over glass. Their light weight reduces freight costs. When dropped onto a hard surface they do not shatter like glass and generally do not break. Conveyor wear caused by the containers in the packaging plant is also reduced. The closure is also generally reusable after a bottle has been opened.

Disadvantages are that PET bottles are easily scratched, and susceptible to chemical attack when they are washed. PET containers also do not tolerate conditions above 60° C. Exposing them to higher temperatures than 60° C. causes deformation and/or shrinkage of the bottles.

Recycling of PET containers was recently approved by the FDA in the USA to permit turning used containers into new ones. Because new resin costs 50 to 75 cents per pound, recycling used bottles is economically attractive. In time, glass soft drink bottles are expected to disappear from the market. This heightens the relevance of PET container processing even further.

The cleaning of PET bottles takes place over a series of steps using caustic immersion tanks and spray wash stages in a bottlewasher. In the wash tanks, product residue, dirt, labels and labeling adhesive are removed. Because the surface of PET bottles is hydrophobic, cleaning them is more difficult than glass bottles. Also, the lower washing temperature decreases the chemical activity of the bottlewashing solution.

Two principle problems in the cleaning of PET bottles are touched on by Laufenberg et al., "Cleaning, Disinfecting, and Transporting Pet Returnables", Brew Bev. Ind. Int. 1, 40–4 (0 ref.) January, 1992.

In this article, the author outlines the susceptibility of the PET bottles to corrosion or hazing. Hazing results from the chemical etching of the surface of the PET container by the caustic present in the wash bath.

An especially challenging problem which affects reusable PET bottles is the occurrence of mold in returned bottles. To simply discard all bottles from which mold can not be removed is prohibitively expensive. Reject rates of 40 to 50% have occurred at certain times of the year in countries located in tropical climates.

The necessary cleaning temperature for PET bottles is 60° C. or less due to the glass transition temperature of PET. If exceeded, PET bottles deform and shrink. The cleaning power of a bottlewashing solution at 60° C. is only one quarter that at 80° C. Bottles returned with product residue, i.e., those bottles that have not been rinsed, are almost always contaminated with microbiological forms of life. The bottle washing solution eliminates the presence of microbiological forms of life such as bacteria, spores, molds, and yeasts present in the bottle. However, at the reduced temperature of 60° C., molds often present a persistent problem in the cleaning and reuse of PET bottles.

PET bottles simply cannot be washed like glass. Glass bottles are normally washed at 80° C. Glass can also be washed with a relatively high concentration of caustic. While glass may be washed with up to 5.0% caustic, as little as 1.5% caustic can cause hazing in a PET container. With glass the washing temperature, the caustic concentration, and the washing time may be adjusted to allow for variability within the environment. In contrast, PET containers cannot withstand high levels of any of these variables.

While various alternatives have been proposed such as lowering the level of caustic, there remains a need in the industry for compositions and methods which allow for the efficient cleaning of PET containers and multiple reuse events.

SUMMARY OF THE INVENTION

The first aspect of the invention is a method for cleaning a polyethylene terephthalate container. The method includes combining a first concentrate with a second concentrate in an alkaline wash solution. The first concentrate includes from about 0.3 to 25 wt-% of a surfactant and from about 5 to 30 wt-% of an acid. The second concentrate includes from about 8 to 60 wt-% of a builder. The method further includes the step of contacting the PET container with the wash solution wherein the removal of soil is undertaken with minimal hazing of the container.

An additional aspect of the invention is a method for cleaning polyethulene terephihalate containers which includes contacting the container with an alkaline wash solution having a temperature ranging from about 50° C. to 60° C. The alkaline wash solution is formulated from a first concentrate, a second concentrate, an alkalinity source, and a balance of water. The first concentrate includes a nonionic surfactant, a first builder, and acid in an amount effective to provide a phase stable solution. The second concentrate includes a nonionic surfactant and a second builder. The first and second concentrate are present in the wash solution in a concentration ranging from about 0.5 wt-% to 1.2 wt-%, and the first nonionic surfactant has a cloud point ranging from about 5° C. to 60° C.

A further aspect of the invention is an alkaline wash solution for cleaning polyethylene terephthalate bottles. The wash solution includes from about 1 to 5 wt-% of a source of alkalinity, from about 480 to 4000 ppm of a builder, from about 6 to 500 ppm of a surfactant, and from about 20 to 800 ppm of a coupler.

The invention is compositions and methods for cleaning polyethylene terephthalate (PET) bottles with enhanced removal of mold and reduced hazing. In addition to the 1 to 3 wt-% caustic commonly used in PET bottle washing procedures, the compositions of the invention include surfactants and builder combination, which heightens cleaning and removes mold.

Hazing generally results from chemical etching caused by caustic present in the wash solution. Hazing is a clouding or dulling of the PET container surface which detracts from the aesthetic character of the container. Surprisingly, it has been found that by using surfactants with appropriate cloud points, hazing may be substantially reduced. Preferably, PET containers treated with the wash solution of the invention are substantially free of hazing.

Further, mold growth, particularly in the inside of returned PET bottles, proves to be a major challenge in bottle washing. Molds are very difficult to remove, even with a solution having as much as 3% caustic. Good cleaning usually removes most of the organic components of mold. However, the inorganic residues of mold may remain on the PET container surface. This may cause a problem similar to water spots. This condition gives a positive test result by methylene blue staining, (Industrial Code of Practice for Refillable PET Bottles, Edition 1 (1993–1994 UNESDA/CESDA, pg. V-18). The compositions and methods of the invention substantially remove soils and both the organic and inorganic residues of mold.

DETAILED DESCRIPTION OF THE INVENTION

The Composition

Generally, the wash solution of the invention is formulated from two concentrate compositions. These two concentrate compositions are combined in an aqueous wash solution with an alkalinity source, before use. These concentrate compositions generally comprise surfactants, an acid, builders such as sequestrants and chelating agents, coupling agents, and various other adjuvants.

A. The Surfactant System

Generally, the compositions of the invention comprise surfactants to facilitate low foaming cleaning, and prevent hazing of the PET container. Any number of surfactants may be used in accordance with the invention including nonionic surfactants, anionic surfactants, amphoteric surfactants, and mixtures thereof.

Nonionic surfactants encompass a wide variety of polymeric compounds which include specifically, but not exclusively, ethoxylated alkylphenols, ethoxylated aliphatic alcohols, ethoxylated amines, ethoxylated ether amines, carboxylic esters, carboxylic amides, and polyoxyalkylene oxide block copolymers.

Preferably, nonionic surfactants are used in the invention such as those which comprise ethylene oxide moieties, propylene oxide moieties, as well a mixtures thereof, and ethylene oxide-propylene oxide moieties in either heteric or block formation. Additionally useful in the invention are nonionic surfactants which comprise alkyl ethylene oxide compounds, alkyl ethylene oxide-propylene oxide compounds and alkyl ethylene oxide-butylene oxide compounds, as well as mixtures thereof. The ethylene oxide propylene oxide moiety and ethylene oxide-butylene oxide moiety may be in either heteric or block formation. Also useful in the invention are nonionic surfactants having any mixture of combination of ethylene oxide-propylene oxide moieties linked to an alkyl chain where the ethylene oxide and propylene oxide moieties may be in any randomized or ordered pattern and of any specific length. Nonionic surfactants useful in the invention may also comprise randomized sections of block and heteric ethylene oxide propylene oxide, or ethylene oxide-butylene oxide.

Preferred nonionic surfactants include alkylphenols, alcohol ethoxylates, and block copolymers of ethylene oxide and propylene oxide.

Examples of nonionic surfactants found useful in the invention include (EO)/(PO) block copolymers having at least about 3 moles (EO) and at least about 15 moles (PO); aryl or aliphatic ethoxylates having at least about 3 moles (EO) which may or may not be capped with methyl, butyl, or benzyl moieties; aryl or aliphatic ethoxylate-propoxylate copolymers having at least about 2 moles of (EO) and from about 4 moles of (PO) and which may also be capped with methyl, butyl or benzyl; and aryl or aliphatic ethoxylate-butoxylate copolymers having at least about 2 moles of (EO) and about 4 moles of (BO) and which may also be capped with methyl, butyl or benzyl. The aliphatic group may comprise any branched or linear $C_8$–$C_{24}$ moiety. The aryl group may generally comprise aromatic structures such as benzyl. An HLB value of 4 to 13 may also be used to characterize surfactants useful in the invention.

Representative nonionics which are useful in the invention include EO/PO block copolymers available from Henkel KGaA; Pluronic L62 and L44 which are EO/PO block copolymers available from BASF; Tergitol 15-S-3, TMN3, TMN10 which are ethoxylated alcohols available from Union Carbide; Surfonic L24-1.3 which is a linear alcohol ethoxylate available from Texaco Chemical Co.; nonyl phenol ethoxylates such as NPE 4.5, NPE 9, and Surfonic N120 available from Texaco Chemical Co.; ethoxylated alkyl amines such as ethoxylated coco amine available from Sherex Chemical Co. as Varonic K-215; an alkyl ethoxylated carboxylic acid such as Neodex 234; and benzylated alcohol ethoxylates and EO/PO block copolymers among other nonionic surfactants.

Also useful in the invention are low foaming surfactants which may oil out of the wash solution at a temperature of 59° C. or less. Preferably, the surfactant system comprises surfactants having a cloud point of about 5° C. to 60° C., preferably from about 10° C. to 50° C., and more preferably of about 10 to 20° C. so that in the alkaline wash solution, the surfactants will oil-out or film and deposit on the PET container surface providing protection against hazing.

One preferred line of surfactants includes Dehypon LT104 which is a $C_{12\text{-}18}$ fatty alcohol $(EO)_{10}$ butyl capped and LS24 which is a $C_{12\text{-}14}$ fatty alcohol $((EO)_2\ (PO)_4)$ both available from Henkel Canada Ltd.

Anionic surfactants may also be used in the invention. Typical commercially available anionic surfactants provide either a carboxylate, sulfonate, sulfate or phosphate group as the functional anion. We have found that carboxylate based anionic surfactants such as alcohol ethoxylate carboxylates reduce hazing of the container. A commercial source of this type of surfactant is Neodox 234-4™ available from Shell Chemical Co.

Amphoteric surfactants may also be used in the invention. Such amphoteric surfactants include betaine surfactants, sulfobetaine surfactants, sarcosinate surfactants, amphoteric imidazolinium derivatives and others. Certain surfactants found useful in hazing reduction include cocoyl and lauroyl sarcosine/sarcosinates such as Hamposyl C and L available from Hampshire Chemical Co.

B. Acid

The composition of the invention may also comprise an acid source. The acid functions to stabilize the surfactant system so that prior to mixing in the wash solution, the concentrate is a true phase stable solution. Once added to the alkaline wash solution the acids are neutralized, become salts, and provide heightened cleaning efficacy and retard the formation of scaling on washing machine components. Generally, the acid may be any number of organic or inorganic acids.

Inorganic acids useful in the composition and the invention include phosphoric acid, polyphosphoric acid or acidic pyrophosphate salts, among others. Organic acids useful in the invention include mono and polycarboxylic acids such as acetic acid, hydroxyacetic acid, citric acid, gluconic acid, glucoheptanoic acid, lactic acid, succinic acid, malonic acid, glutaric acid, and mixtures thereof.

C. Builders

The composition of the invention may also comprise a builder. Builders, i.e., sequestrants and chelating agents, retard the precipitation of scale onto the side walls of the PET container and the bottle washing machine. Builders also facilitate soil suspension, bind hardness ions and, in turn, enhance cleaning, during the washing process. In accordance with one embodiment of the invention the first concentrate may contain a first builder and the second concentrate may contain a second builder.

Builders which may be used in accordance with the invention include sequestrants such as phosphonates, phosphinates, acrylates and polyacrylates, and polycarboxylates, among others. Also useful as builders are maleate polymers and copolymers of maleate and acrylate; salts such as polyaspartic and polyglutaric acid salts; erythorbic acid; polyacrylamidopropyl sulfonate; and phosphino carboxylic acid, among others.

Water soluble acrylic polymers which may be used include polyacrylic acid, polymethacrylic acid, acrylic acid-methacrylic acid copolymers, hydrolyzed polyacrylamide, hydrolyzed methacrylamide, hydrolyzed acrylamide-methacrylamide copolymers, and mixtures thereof. Water soluble salts or partial salts of these polymers such as their respective alkaline metal (for example sodium or potassium) or ammonium salts can also be used.

Also useful as builders are phosphonic acids and phosphonic acid salts. Such useful phosphonic acids include, mono, di, tri, tetra and, penta phosphonic acids which can contain groups capable of forming anions under alkaline conditions.

The phosphonic acid may also comprise a lower molecular weight phosphonopolycarboxylic acid such as one having about 2–4 carboxylic moieties and about 1 to 5 phosphonic acid groups. Such acids include 1 phosphono-1-methylsuccinic acid, phosphonosuccinic acid and 2-phosphonobutane-1,2,4 tricarboxylic acid.

Preferred sequestrants include the Dequest® sequestrants available from Monsanto Co. including Dequest 2006® which is amino tri(methylene phosphonic acid) pentasodium salt; Dequest 2010® which is 1-hydroxyethylidene-1,1-diphosphonic acid; Bayhibit AM® available from Mobay Chemical Co. which is 2-phosphonobutane-1,2,4-tricarboxylic acid; Dequest 2000® which is aminotri (methylene phosphonic acid); and Belsperse 161® from Ciba Geigy which is a phosphino polycarboxylic acid.

The builder present in either concentrate may also be a chelating,agent. Unlike a sequestrant, the chelating agent tends to bind alkali earth metals present in the wash solution and hold these compounds in solution. It is believed that mold uses the organic portion of nutrients leaving behind inorganic salts. As a result, the ineffective removal of mold is often indicated by inorganic salts which are left behind on the surface of the PET container. The chelating agent removes these inorganic salts that are found underneath the mold.

The number of bonds capable of being formed by a chelating agent upon a single hardness ion is reflected by labeling the chelating agent as bidentate (2), tridentate (3), tetradendate (4), etc. Any number of chelating agents may be used in accordance with the invention. Representative chelating agents include salts of amino carboxylic acids, phosphonic acid salts, water soluble acrylic polymers, among others.

Suitable amino carboxylic acid chelating agents include N-hydroxyethyliminodiacetic acid, nitrilotriacetic acid (NTA), ethylenediaminetetraacetic acid (EDTA), N-hydroxyethyl-ethylenediaminetriacetic acid (HEDTA), and diethylenetriaminepentaacetic acid (DTPA), as well as isoserine-N,N-diacetic acid, beta alanine N,N-diacetic acid, sodium glycolate, and tripolyphosphate, among others. In accordance with one useful aspect of the invention the second builder present in the second concentrate comprises an amino carboxylic acid chelating agent, preferably of ethylene diamine tetracetic acid or salts thereof.

D. Couplers

The composition of the invention may also include a coupling agent. The coupling agent functions to stabilize the concentrate composition so that it is a true phase stable solution.

To this end, any number of organic coupling agents may be used including sulfates, sulfonates, as well as monofunctional and polyfunctional alcohols. Preferred coupling agents include sulfonate and sulfate compounds such as sodium xylene sulfonate, sodium cumene sulfonate, sodium toluene sulfonate, 2-ethylhexyl sulfate, alkyl diphenyl oxide disulfonate where the alkyl group is either a branched $C_{12}$ or a linear $C_{10}$, sodium alkyl naphthalene sulfonate, and sodium octane sulfonate and disulfonate, and mixtures thereof.

Those coupling agents which have been found useful include linear alkyl alcohols such as, for example, ethanol, isopropanol, and the like. Also useful are polyfunctional hydroxy compounds such as alkylene glycols like hexylene glycol and propylene glycol; phosphate esters including Gafac RP710 from Rhone-Poulence Chemicals, and Triton H-66 from Rohm & Haas Co.

E. Adjuvants

The compositions and methods of the invention may use any number of other adjuvants such as added nonionic surfactant defoamers such as those disclosed in U.S. Pat. No. 5,516,451 to Schmitt et al. which is incorporated herein by reference. Tracing compounds such as potassium iodide, colorants and dyes, fragrances, and preservatives, among other constituents are also useful in the invention.

The Method of Use

The method of the invention provides heightened cleaning efficacy of PET containers, removing soils, inorganic salts, and molds while retarding hazing of the containers. This result is obtained by formulating a first acidic concentrate with a high concentration of surfactant and a separate second concentrate having a high concentration of builder.

In accordance with one aspect of the invention the first and second concentrates may be incompatible if mixed separately from a wash solution. Incompatibility in this context stems from different pH requirements of the two different concentrates. The first concentrate may generally have an acidic pH of less than about 2 to maintain the solubility of the surfactant system. The pH of the second concentrate is selected to provide complete solubility of the builder and is generally alkaline. Combination of the two concentrates before dilution in the wash solution may result in phase separation of the surfactant system or the builder depending on pH.

In use the two concentrates are combined in an alkaline wash system to provide heightened cleaning efficacy with good building efficacy. Illustrative concentration ranges for each of the two concentrates are provided below:

TABLE 1

| | Concentration (wt-%) | | |
|---|---|---|---|
| | Useful | Preferred | More Preferred |
| Concentrate 1 | | | |
| Surfactant System | 0.3–25 | 1–15 | 3–10 |
| First Builder | 0–20 | 5–20 | 10–20 |
| Coupler | 1–40 | 30–20 | 5–15 |
| Acid (100% w/w) | 5–30 | 10–20 | 10–15 |
| Water | q.s. | q.s. | q.s. |
| Concentrate 2 | | | |
| Surfactant System | 0–10 | 0.1–5 | 0.1–1 |
| Second Builder | 8–60 | 15–45 | 30–45 |
| Water | q.s. | q.s. | q.s. |
| Use Solution (ppm) | | | |
| Surfactant | 6–500 | 20–300 | 60–200 |
| Builder | 480–4000 | 1000–3000 | 2000–3000 |
| Coupling Agent | 20–800 | 60–400 | 100–300 |

In use this system is diluted into a wash solution comprising from about 0.1 wt-% to 0.8 wt-%, preferably from about 0.2 wt-% to 0.3 wt-% of the first concentrate and from about 0.2 to 1.2 wt-%, and preferably from about 0.4 wt-% to 0.8 wt-% of the second concentrate. The ratio of the first concentrate to the second concentrate in the alkaline wash solution generally ranges from about 0.1:0.5 to 0.1:1.0, and preferably from about 0.1:0.2 to 0.15:0.3. Generally the alkaline wash solution may have a total of from about 0.3 to 2.0 wt-% and preferably from about 0.5 to 1.2 wt-% of both concentrate 1 and concentrate 2.

In accordance with one preferred aspect of the invention, the wash solution comprises at least about 1000 ppm EDTA, at least about 5 ppm of a phosphonate compound, and at least about 100 ppm of a gluconate compound.

The washing of PET containers generally takes place over a number of steps. The PET containers are emptied and pre-rinsed, then soaked in the wash solution. The wash solution generally has anywhere from 1.0 wt-% to 5 wt-% and preferably from 1.5 wt-% to 3 wt-% caustic (NaOH). Into this system is mixed Concentrate 1 and Concentrate 2 into which the PET containers are applied. Washing tends to take place over a time period which ranges from about 7 to 20 minutes. The wash temperature is about 59° C. ±1° C. The containers then pass through a weak caustic stage where water is run into the tank to continue cleaning and begin rinsing by reducing the sodium hydroxide concentration. The caustic concentration may be maintained by a conductivity controller. The containers then pass through at least three rinse stages which sequentially rinse the containers with warm water and cold water. The final rinsing takes place with potable water after which time the containers are turned upright, inspected, and filled.

EXAMPLES

The following working examples provide a nonlimiting illustration of the invention.

Working Example 1

Hazing was studied using various compositions as detailed. Provided below in Table 2 are examples which were tested along with other compositions in Table 3.

TABLE 2

| COMPOSITIONS | EXAMPLE 1A | EXAMPLE 1B |
|---|---|---|
| $H_3PO_4$ (75% w/w) | 10.00 | |
| Gluconic acid (50% w/w) | 10.00 | |
| Dehypon LT-104 ($C_{12-18}H_{24-37}(EO)_{10}O_nC_4H_9$) | 11.00 | |
| Dehypon LS–24 ($C_{12-14}H_{25-29}(EO)_2(PO)_4OH$) | 5.00 | |
| Triton BG–10 (alkyl polyglucoside) | | 1.00 |
| Dequest 2000 ® (50% w/w) (amino trimethylene phosphonic acid) | 6.00 | 6.00 |
| Dequest 2010 (60% w/w) (1-hydroethylidene-1, 1-diphosphonic acid) | 2.00 | |
| Bayhibit-AM ® (50% w/w) (2-phosphonobutane-1,2,4-tricarboxylic acid) | 3.00 | |
| Ethylene Diamine Tetra-Acetic Acid, Tetrasodium salt (powder) | | 39.00 |
| Sodium Cumene Sulfonate (40% w/w) | 30.00 | |
| VN-11 (oleyl alcohol diethylene glycol) | 0.50 | |
| Potassium Iodide | 0.25 | |

Chemical hazing was studied with PET strips (0.5"×2") which were cut out of amorphous (low crystallinity) PET sheeting. The strips were immersed in about 200 mL of 2.8% caustic solutions containing various amounts of additives being tested. The solutions were shaken at 100 rpm in a water bath with a temperature maintained between 58–60° C. for 24–72 hours. The degree of hazing/corrosion was evaluated visually and gravimetrically using water (hazing rating of 0) and a 2.8% caustic solution (hazing rating of 10) as references.

TABLE 3

| EXAMPLE | ACTIVE | CONCEN-TRATION | HAZING |
|---|---|---|---|
| 1A | Table 2 | 0.05 wt-% | 0.5 |
| 1A | Table 2 | 0.2 wt-% | 0.5 |
| 1A | Table 2 | 0.6 wt-% | 0.5 |
| 1A | Table 2 | 2.0 wt-% | 0.5 |
| 1B | Table 2 | 0.05 wt-% | 10 |
| 1B | Table 2 | 0.1 wt-% | 7.5 |
| 1B | Table 2 | 0.2 wt-% | 5.5 |
| 1B | Table 2 | 0.35 wt-% | 1.5 |
| 1C | Dehypon LT104 ($C_{12-18}H_{24-37}(EO)_{10}O_nC_4H_9$) | 10 ppm | 0 |
| 1D | Dehypon LS24 ($C_{12-14}H_{25-29}(EO)_2(PO)_4OH$) | 10 ppm | 1 |
| 1E | TritonBG-10 (alkyl poly glucoside (70% w/w)) | 300 ppm | 8 |
| 1F | Glucopon 600 (alkyl polyglucoside ($C_{12.8}H_{27.6}O(C_6H_{10}O_5)_{0-3}H$)) | 500 ppm | 10 |
| 1G | Sodium Cumene Sulfonate | 300 ppm | 9 |
| Control 1 | Water | 0 wt-% | 0 |
| Control 2 | Caustic | 2.3 wt-% | 10 |

Hazing was measured against a scale of 0 for no hazing such as with water and 10 for 2.8% caustic. Examples 1C and 1D, as well as the series of trials run on Example 1A proved these compositions to be very effective in preventing hazing whether used alone or in conjunction with sequestrants.

Working Example 2

A second analysis of hazing was undertaken using the method of Example 1 with 100 ppm of each active (EXS. 2A–2W), and 2.8 wt-% of NaOH in the wash water (except for the control); the results are reported in Table 4.

TABLE 4

| EXAMPLE | ACTIVE | HAZING |
|---|---|---|
| 2A | $(PO)_{24}(EO)_{15}[(PO)_{13.0}(EO_{15.5})](EO)_{15}(PO)_{24}$ | 0 |
| 2B | $(PO)_{13}(EO)_{15}[(EO)_{2.2}(PO)_{25.5}](EO)_{15}(PO)_{13}$ | 0 |
| 2C | $(PO)_{5}(EO)_{15}[(PO)_{13.0}(EO_{15.5})](EO)_{15}(PO)_{24}$ | 1 |
| 2D | Pluronic L62<br>$HO(EO)_{11}(PO)_{30}(EO)_{8}H$ | 0 |
| 2E | Pluronic L44<br>$HO(EO)_{11}(PO)_{21}(EO)_{11}H$ | 0 |
| 2F | Tergitol 15-S-3<br>$(C_{11-15}H_{23-31}(EO)_{3}OH)$ | 0 |
| 2G | Tergitol TMN 3<br>$C_{12}H_{25}(EO)_{3}OH$ | 0 |
| 2H | Tergitol TMN 10<br>$C_{12}H_{25}(EO)_{10}OH$ | 0 |
| 2I | Surfonic L24-1.3<br>$(C_{12-14}(EO)_{1.3}OH)$ | 0 |
| 2J | Plurafac LF131<br>$(C_{12.7}(EO)_{7}(BO)_{1.7}OCH_{3})$ | 15 |
| 2K | Dehypon LT104<br>$(C_{12-18}H_{24-37}(EO)_{10}O_{n}C_{4}H_{9})$ | 0 |
| 2L | $(C_{6}H_{5}CH_{2})$—$(PO)_{13}(EO)_{15}[(EO)_{2.2}/(PO)_{25.5}](EO)_{15}(PO)_{13}$—<br>$(CH_{2}C_{6}H_{5})$ | 0 |
| 2M | $C_{12-14}O(EO)_{10-12}$—$CH_{2}C_{6}H_{5}$ | 0 |
| 2N | NPE 4.5<br>nonyl phenol $(EO)_{4.5}$ | 2 |
| 2O | NPE 9.5<br>nonyl phenol $(EO)_{9.5}$ | 0 |
| 2P | Surfonic N120<br>$C_{9}H_{19}C_{6}H_{4}(EO)_{12}OH$ | 6 |
| 2Q | Neodox 23-4<br>$(C_{12-13}(EO)_{4}OCH_{2}COOH)$ | 4 |
| 2R | Varonic K215<br>(cocoamine ethoxylate $(EO)_{15}$) | 4 |
| 2S | Hamposyl C<br>coco sarcosine $(C_{12-18}H_{25-37}C(O)N(CH_{3})CH_{2}COOH)$ | 1 |
| 2T | Hamposyl L<br>lauroyl sarcosine | 4 |
| 2U | Hamposyl L 30<br>sodium laroyl sarcosinate | 10 |
| 2V | Silwet L77<br>$(CH_{3})_{3}SiOSi[(CH_{3})OSi(SH_{3})_{3}][(CH_{2})_{3}(EO)_{8}OCH_{3}]$ | 5 |
| 2W | 2.8% NaOH (control) | 10 |

Working Example 3

Soiled bottles from the field were cut into test panels (roughly 2"×3"). A washing test was done in 1000 mL solution with stirring (500 rpm) for 10 min., followed by a 1 min. water rinse (8 psi nozzle spray, top down). Methylene blue staining was used to evaluate soil level both before and after the cleaning in accordance with the *Industrial Code of Practice for Refillable Pet Bottles*, Edition 1 (1993–1994 UNESDA/CESDA), page V-18. The above steps were repeated every 10 minutes for the 20 minute and 30 minute cleaning iterations. The wash solution comprised 2.8 wt-% caustic, 0.6 wt-% Example 1B, and the varying amounts of Example 1A as shown in Table 5A below. Quadruplet data was used for statistical average. The data was reported as total cleaned/total washed.

TABLE 5A

| | 2.8% caustic<br>0.6% Example 1B | | |
|---|---|---|---|
| | Cleaning Time | | |
| Example 1A (wt-%) | 10 min | 20 min | 30 min |
| 0.05 | 1/4 | 1/4 | 2/4 |
| 0.10 | 1/4 | 2/4 | 2/4 |
| 0.15 | 2/4 | 3/4 | 3/4 |
| 0.20 | 2/4 | 2/4 | 3/4 |
| 0.25 | 3/4 | 3/4 | 3/4 |
| 0.30 | 4/4 | | |

TABLE 5B

In this example the wash solution comprised 2.8 wt-% caustic and 0.2 wt-% Example 1A, with varying amounts of Example 1B as indicated below. Data was reported as in Table 5A.

| | Cleaning Time | | |
|---|---|---|---|
| Example 1B (wt-%) | 10 min | 20 min | 30 min |
| 0.60 | 2/4 | 2/4 | 2/4 |
| 1.20 | 4/4 | | |
| 0.80 | 4/4 | | |

TABLE 5C

Different concentrations of Example 1A and 1B were combined to test cleaning efficacy. Data was reported as in Tables 5A and 5B.

| Example 1A | Example 1B | Cleaning Time | | |
|---|---|---|---|---|
| (wt-%) | (wt-%) | 10 min | 20 min | 30 min |
| 0.10 | 1.20 | 3/4 | 3/4 | 3/4 |
| 0.15 | 1.20 | 3/4 | 3/4 | 3/4 |
| 0.20 | 1.20 | 4/4 | | |
| 0.10 | 1.80 | 3/4 | 3/4 | 3/4 |
| 0.15 | 1.80 | 3/4 | 4/4 | |
| 0.20 | 1.80 | 4/4 | | |
| 0.20 | 0.7 | 2/4 | 2/4 | 3/4 |
| 0.20 | 0.8 | 2/4 | 2/4 | 3/4 |
| 0.20 | 1.0 | 4/4 | | |
| 0.30 | 0.4 | 2/4 | 2/4 | 2/4 |
| 0.40 | 0.4 | 2/4 | 2/4 | 2/4 |

TABLE 5D

The cleaning efficacy of wash solutions having set concentrations of Example 1A and Example 1B with varied concentrations of caustic was then analyzed. Example 1A was added at 0.2 wt-% to the wash solution and Example 1B was added at 0.8 wt-% to the wash solution. The results are reported below in the same manner as Tables 5A–5C.

| | Cleaning Time | | |
|---|---|---|---|
| Caustic (wt-%) | 10 min | 20 min | 30 min |
| 1.5 | 2.4 | 2.4 | 3/4 |
| 2.0 | 2/4 | 2/4 | 4/4 |
| 2.6 | 3/4 | 3/4 | 4/4 |

The above specification, examples and data provide a complete description of the manufacture and use of the composition of the invention. Since many embodiments of the invention can be made without departing from the spirit and scope of the invention, the invention resides in the claims hereinafter appended.

We claim:

1. A method for cleaning a polyethylene terephthalate container, said method comprising the steps of:

combining a first concentrate with a second concentrate in an alkaline wash solution, wherein (a) said fist concentrate comprises:

(i) from about 0.3 to 25 wt-% of a surfactant; and (ii) from about 5 to 30 wt-% of an acidd;

(b) said second concentrate comprises:

(i) from about 8 to 60 wt-% of a builder;

said method further comprising the step of soaking said container in said wash solution wherein the removal of soil is undertaken with minimal hazing of the container;

wherein said first concentrate has a pH of less than about 2.

2. The method of claim 1, wherein said first concentrate comprises a first builder and said second concentrate comprises a second builder.

3. The method of claim 1, wherein said second concentrate further comprises a surfactant.

4. The method of claim 1, wherein the concentration of the first concentrate added to said wash solution ranges from about 0.1 wt-% to 0.8 wt-% of the wash solution.

5. The method of claim 1, wherein the concentration of the second concentrate added to the wash solution ranges from about 0.2 wt-% to 1.2 wt-% of the wash solution.

6. The method of claims 4 or 5, wherein the ratio of the first concentrate to the second concentrate in the wash solution ranges from about 0.1:0.5 to 0.:1.0.

7. The method of claim 1, wherein said wash solution comprises from about 0.3 wt-% to 2.0 wt-% of said first and second concentrate.

8. The method of claim 1, wherein the alkaline wash solution comprises from about 1 wt-% to 5 wt-% of a source of alkalinity.

9. The method of claim 8, wherein said alkalinity source comprises about 1.5 wt-% to 3 wt-% caustic.

10. The method of claim 1, wherein said first concentrate further comprises a coupler.

11. The method of claim 10, wherein said coupler is selected from the group consisting of sodium xylene sulfonate, 2-ethyl hexyl sulfate, sodium cumene sulfonate, sodium toluene sulfonate, sodium alkyl naphthalene sulfonate, sodium octane sulfonate, a branched alkyl diphenyl oxide disulfonate, a linear alkyl diphenyl oxide disulfonate, and mixtures thereof.

12. The method of claim 10, wherein said coupler comprises a polyfunctional hydroxy compound.

13. The method of claim 10, wherein said coupler comprises a phosphate ester.

14. The method of claim 1, wherein said wash solution has a temperature of from about 50 to 60° C.

15. The method of claim 1, wherein said wash solution has a temperature of less than about 60° C.

16. The method of claim 1, wherein said surfactant is selected from the group consisting of a nonionic surfactant, an anionic surfactant, an amphoteric surfactant and mixtures thereof.

17. The method of claim 1, wherein said surfactant comprises a nonionic surfactant.

18. The method of claim 17, wherein said nonionic surfactant is selected from the group consisting of an ethylene oxide—propylene oxide block copolymer, an alkyl ethoxylate, an alkyl ethoxylate—propoxylate, an alkyl ethoxylate—butoxylate, and mixtures thereof.

19. The method of claim 2, wherein said first builder is selected from the group consisting of phosphonates, phosphinates, acrylates, polycarboxylates, and mixtures thereof.

20. The method of claim 2, wherein said second builder comprises a chelating agent of ethylene diamine tetraacetic acid or a salt thereof.

21. The method of claim 2, wherein said second concentrate is not compatible with said first concentrate.

22. The method of claim 21, wherein said second builder comprises an alkylene polyamine polyacetic acid salt.

23. The method of claim 1, wherein said acid is selected from the group consisting of an organic acid, an inorganic acid, and mixtures thereof.

24. The method of claim 23, wherein said acid comprises an organic acid selected from the group consisting of citric acid, acetic acid, hydroxy acetic acid, gluconic acid, glucoheptanoic acid, lactic acid, and mixtures thereof.

25. The method of claim 17, wherein said nonionic surfactant has a cloud point in the alkaline wash solution ranging from about 5° C. to 60° C.

26. The method of claim 1, wherein after washing said polyethylene terephthalate container is free of mold.

27. The method of claim 10, wherein said wash solution comprises from about 6 to 500 ppm surfactant, from about 480 to 4000 ppm builder, and from about 20 to 800 ppm coupler.

28. A method for cleaning polythylene terephthalate containers, said method comprising the steps of soaking the container in an alkaline wash solution having a temperature ranging from about 50° C. to 60° C., said alkaline wash solution formulated from a first concentrate, a second concentrate, an alkalinity source, and a balance of water;

(a) said first concentrate comprising a first nonionic surfactant, a first builder, and acid in an amount effective to provide a phase stable solution having a pH of less than about 2; and (b) said second concentrate comprising a second nonionic surfactant, and a second builder wherein said first and second concentrate are present in the wash solution in a concentration ranging from about 0.3 wt-% to 2.0 wt-%, said first nonionic surfactant having a cloud point ranging from about 5° C. to 60° C.

29. The method of claim 28, wherein (a) said first concentrate comprises (i) from about 1 to 15 wt-% of said first nonionic surfactant;

(ii) from about 5 to 20 wt-% of said first builder; and (iii) from about 10 to 20 wt-% of said acid; and (b) said second concentrate comprises (i) from about 0.1 to 5 wt-% of said second nonionic surfactant; and (ii) from about 15 to 45 wt-% of said second builder.

30. The method of claim 29, wherein the concentration of the first concentrate added to said wash solution ranges from about 0.1 wt-% to 0.8 wt-% of the wash solution.

31. The method of claim 29, wherein the concentration of the second concentrate added to the wash solution ranges from about 0.2 wt-% to 1.2 wt-% of the wash solution.

32. The method of claims 30 or 31, wherein the ratio of the first concentrate to the second concentrate in the wash solution ranges from about 0.1:0.5 to 0.:1.0.

33. The method of claim 28, wherein said wash solution comprises from about 0.3 wt-% to 2.0 wt-% of said first and second concentrate.

34. The method of claim 28, wherein the alkaline wash comprises from about 1 wt-% to 5 wt-% of a source of alkalinity.

35. The method of claim 28, wherein said alkalinity source comprises about 1.5 wt-%, to 3 wt-% caustic.

36. The method of claim 28, wherein said first concentrate comprises a coupler.

37. The method of claim 36, wherein said coupler is selected from the group consisting of sodium xylene sulfonate, 2-ethyl hexyl sulfate, sodium cumene sulfonate, sodium toluene sulfonate, sodium alkyl naphthalene sulfonate, sodium octane sulfonate, a branched alkyl diphenyl oxide disulfonate, a linear alkyl diphenyl oxide disulfonate, and mixtures thereof.

38. The method of claim 36, wherein said coupler comprises a polyfunctional hydroxy compound.

39. The method of claim 36, wherein said coupler comprises a phosphate ester.

40. The method of claim 28, wherein said wash solution has a temperature of from about 50 to 60° C.

41. The method of claim 28, wherein said wash solution has a temperature of less than about 60° C.

42. The method of claim 28, wherein said first builder is selected from the group consisting of phosphonates, phosphinates, acrylates, polycarboxylates, and mixtures thereof.

43. The method of claim 28, wherein said second builder is not compatible with said first concentrate.

44. The method of claim 43, wherein said second builder comprises an alkylene polyamine polyacetic acid salt.

45. The method of claim 28, wherein said acid is selected from the group consisting of an organic acid, an inorganic acid, and mixtures thereof.

46. The method of claim 45, wherein said acid comprises an organic acid selected from the group consisting of citric acid, acetic acid, hydroxy acetic acid, gluconic acid, glucoheptanoic acid, lactic acid, and mixtures thereof.

47. The method of claim 28, wherein said first nonionic surfactant has a cloud point in the alkaline wash solution ranging from about 10° C. to 50° C. and mixtures thereof.

48. The method of claim 28, wherein after washing said polyethylene terephthalate container is free of mold.

49. The method of claim 36, wherein said wash solution comprises from about 6 to 500 ppm surfactant, from about 480 to 4000 builder, and from about 20 to 800 ppm coupler.

50. A method for cleaning a polyethylene terephthalate container, said method comprising the steps of:

combining a first concentrate with a second concentrate in an alkaline wash solution (a) said first concentrate comprising:

(i) from about 0.3 to 25 wt-% of a surfactant; and (ii) from about 5 to 30 wt-% of an acid;

(iii) a coupling agent, said coupling agent comprising a phosphate ester;

(b) said second concentrate comprising:

(i) from about 8 to 60 wt-% of a builder;

said method further comprising the step of contacting said container with said wash solution wherein the removal of soil is undertaken with minimal hazing of the container.

51. A method for cleaning polyethylene terephthalate containers, said method comprising the steps of contacting the container with an alkaline wash solution having a temperature ranging from about 50° C. to 60° C., said alkaline wash solution formulated from a first concentrate, a second concentrate, an alkalinity source, and a balance of water;

(a) said first concentrate comprising a first nonionic surfactant, a first builder, acid in an amount effective to provide a phase stable solution, and a coupling agent comprising a phosphate ester; and (b) said second concentrate comprising a second nonionic surfactant, and a second builder wherein said first and second concentrate are present in the wash solution in a concentration ranging from about 0.3 wt-% to 2.0 wt-%, said first nonionic surfactant having a cloud point ranging from about 5° C. to 60° C.

* * * * *